United States Patent [19]

Honkura et al.

[11] Patent Number: 5,000,797

[45] Date of Patent: Mar. 19, 1991

[54] METHOD FOR PRODUCING A STAINLESS STEEL HAVING A GOOD CORROSION RESISTANCE AND A GOOD RESISTANCE TO CORROSION IN SEAWATER

[75] Inventors: Yoshinobu Honkura, Konanshi; Toru Matsuo, Tokaishi, both of Japan

[73] Assignee: Aichi Steel Works, Limited, Aichi, Japan

[21] Appl. No.: 533,851

[22] Filed: Jun. 6, 1990

Related U.S. Application Data

[60] Division of Ser. No. 253,338, Oct. 3, 1988, Continuation of Ser. No. 90,092, Aug. 27, 1987, abandoned.

[30] Foreign Application Priority Data

Aug. 30, 1986 [JP] Japan ..... 61-204763

[51] Int. Cl.[5] ..... C21D 8/00

[52] U.S. Cl. ..... 148/12 E; 148/12.4

[58] Field of Search ..... 148/12 E, 12.4

[56] References Cited

FOREIGN PATENT DOCUMENTS

| | | | |
|---|---|---|---|
| 0083191 | 7/1983 | European Pat. Off. | 148/12 E |
| 59-129731 | 7/1984 | Japan | 148/12 E |
| 62-4825 | 1/1987 | Japan | 148/12 E |

*Primary Examiner*—Deborah Yee

*Attorney, Agent, or Firm*—Oblon, Spivak, McClelland, Maier & Neustadt

[57] ABSTRACT

A stainless steel fundamentally comprises of, by weight, not more than 0.03% C., not more than 2.0% Si, not more than 5.0% Mn, 6–13% Ni, 16–21% Cr, 0.10–0.30% of N, and 0.02–0.25% Nb with the balance being Fe and inevitable impurity elements. The steel has a good corrosion resistance and a resistance to corrosion in seawater. The steel may further comprise at least one member of Mo and Cu each in an amount of not more than 0.4% S, Se and Te each in an amount of not more than 0.08% Bi, Pb, V, Ti, W, Ta, Hf, Zr and Al each in an amount of not more than 0.30% and P, Ca, Mg and rare earth elements each in an amount of not more than 0.01%. The steel has a recrystallized and worked double structure when subjected to a process comprising rough rolling an steel ingot at a temperature ranging from 1000 to 1200% at a working rate of not less than 50%, cooling at a cooling rate of not less than 4° C./min, subsequently finish rolling at a temperature ranging from 800° to 1000° C., at a working rate of not less than 20%, and cooling at a cooling rate of not less than 4° C./min.

7 Claims, 4 Drawing Sheets x200 x20,000 x200 x20,000 x200
980°C x20,000
980°C x200
900°C x20,000
900°C x200
820°C x20,000
820°C x200
1,050°C x20,000
1,050°C x200
750°C x20,000
750°C

METHOD FOR PRODUCING A STAINLESS STEEL HAVING A GOOD CORROSION RESISTANCE AND A GOOD RESISTANCE TO CORROSION IN SEAWATER

This is a division of U.S. patent application Ser. No. 07/253,338, filed on Oct. 3, 1988, which is a continuation of U.S. patent application Ser. No. 07/090,092, filed Aug. 27, 1987, now abandoned.

BACKGROUND OF THE INVENTION

1. Field of the Invention

This invention relates to austenitic stainless steels which are useful in propeller shafts, pump shafts, motor shafts all for ships and shafts for agitators and which have a high corrosion fatigue strength, loading endurance, corrosion resistance in seawater, and ductility. The present invention also relates to a method for producing such steels.

2. Description of the Prior Art

Known steels used for the propeller shafts, pump shafts and motor shafts for ships are SUS 304, SUS 316, SUS 630, and SUS 329 stainless steels (Japanese Industrial Standard). However, these steels are unsatisfactory in corrosion fatigue strength and are not satisfactory when used in an environment such as in seawater or city water where pitting corrosion is produced. For instance, SUS 304 has a corrosion fatigue strength of about 18 kgf/mm$^2$, a pitting potential of about 280 mV and an endurance of about 27 kgf/mm$^2$, which are low in all characteristics. SUS 316 in which 12% of Ni with 2.5% of Mo being contained has a pitting potential of about 420 mV and has thus a good resistance to corrosion in seawater, though Ni content of SUS 316 is greater than that of SUS 304. However, its corrosion fatigue strength of about 20 kgf/mm$^2$ and endurance of about 28 kgf/mm$^2$ are not so high. Moreover, SUS 630 in which 4.5% of Ni, 3.5% of Cu and 0.35% of Nb are contained has a good corrosion fatigue strength of about 32 kgf/mm$^2$ and a good endurance of about 102 kgf/mm$^2$, but its pitting potential is about 170 mV, so that the resistance to corrosion in seawater is thus poor. SUS 329 JI, which is an austenite-ferrite two-phase stainless steel composed of 25Cr-4Ni-1Mo, has a high pitting potential of about 550 mV and thus, exhibits a good resistance to corrosion in seawater, but has a low corrosion fatigue strength of about 28 kgf/mm$^2$ and a low endurance of about 48 kgf/mm$^2$. As will be seen from the above, the conventional stainless steels are not satisfactory with respect to all the characteristics including the corrosion fatigue strength, corrosion resistance in seawater and endurance.

SUMMARY OF THE INVENTION

It is an object of the present invention to provide a stainless steel which can satisfy the requirements for propeller shafts, pump shafts and the like for ships that the corrosion fatigue strength is not lower than 30 kgf/mm$^2$, the pitting potential is not lower than 300 mV and the endurance is not lower than 55 kgf/mm$^2$ and has thus excellent resistances to corrosion fatigue and corrosion in seawater and good endurance.

The present inventors found that austenitic stainless steels could be improved in resistances to corrosion fatigue and resistance in seawater and an endurance when the content of C was reduced while adding suitable amounts of N and Nb therein.

Furthermore, when the steels having a reduced content of C to which N and Nb are added were worked by a specific process, the resistances to corrosion fatigue and corrosion in seawater and the endurance could be remarkably improved. This specific process comprises heating the steel to a predetermined temperature, subjecting it to rough rolling, cooling the just rolled steel at a predetermined cooling rate to form a fine recrystallized structure by static recrystallization, further subjecting to finish rolling, and cooling the thus rolled steel at a predetermined cooling rate to give a "recrystallized and worked double structure". The term "recrystallized and worked double structure" used herein is intended to mean a structure whose optical microscopic structure is the same as a recrystallized structure of fine crystal grains after solid solution treatment, but whose electron microscopic structure has dislocations of a high density and shows worked structures of several microns in size which are divided with sub-boundary structures.

The steel according to the present invention comprises, by weight, not more than 0.03% of C, not more than 2.0% of Si, not more than 5.0% of Mn, from 6 to 13% of Ni, from 16 to 21% of Cr, from 0.10 to 0.30% of N, and from 0.02 to 0.25% of Nb with the balance being Fe and inevitable impurity elements.

The steel of the present invention may further comprise at least one of the following elements in defined amounts: not more than 4.0% of Mo, not more than 4.0% of Cu, not more than 0.08% of S, not more than 0.08% of Se, not more than 0.08% of Te, not more than 0.10% of P, not more than 0.30% of Bi, not more than 0.30% of Pb, not more than 0.01% of B, not more than 0.30% of V, not more than 0.30% of Ti, not more than 0.30% of W, not more than 0.30% of Ta, not more than 0.30% of Hf, not more than 0.30% of Zr, not more than 0.30% of Al, not more than 0.01% of Ca, not more than 0.01% of Mg and not more than 0.01% of rare-earth elements. The lower limits of these elements are a trace, respectively, when incorporated in a steel.

BRIEF DESCRIPTION OF THE DRAWINGS

A better understanding of the prior art and of the present invention will be obtained by reference to the detailed description below, and to the attached drawings, in which.

DETAILED DESCRIPTION OF THE PREFERRED EMBODIMENTS

The present invention relates to stainless steels having a good corrosion resistance and a good resistance to corrosion in seawater and also to a method for producing such steels.

The steel according to the present invention fundamentally contains, by weight, not more than 0.03% of C, not more than 2.0% of Si, not more than 5.0% of Mn, from 6 to 13% of Ni, from 16 to 21% of Cr, from 0.10 to 0.30% of N and from 0.02 to 0.25% of Nb with the balance being Fe and inevitable impurity elements. This steel will be hereinafter referred to simply as "first steel".

The corrosion resistance of the first steel can be further improved when either at least one of not more than 4% of Mo and not more than 4% of Cu, or not more than 0.002% of S is added to the first steel. This steel will be hereinafter referred to as "second steel".

When one or more of not more than 0.080% of Se, not more than 0.080% of Te, not more than 0.080% of S and not more than 0.100% of P are added to the first steel, the machinability of the steel can be improved. This steel will be hereinafter referred to as "third steel".

Similarly, when one or more of not more than 0.30% of Bi and not more than 0.30% of Pb, and not more than 0.0100% of B are added to the first steel, the machinability of the first steel can be improved without deterioration of the hot workability. This steel will be hereinafter referred to as "fourth steel".

Moreover, if one or more of not more than 0.30% of V, not more than 0.30% of Ti, not more than 0.30% of W, not more than 0.30% of Ta, not more than 0.30% of Hf, not more than 0.30% of Zr and not more than 0.30% of Al are added to the first steel, the strength can be improved. This steel will be hereinafter referred to as "fifth steel".

When one or more of from 0.0020 to 0.0100% of B, from 0.0020 to 0.0100% of Ca, from 0.0020 to 0.0100% of Mg and from 0.0020 to 0.0100% of rare earth elements are added to the first steel, the hot workability of the first steel can be further improved. This steel will be hereinafter referred to as "sixth steel".

The second steel according to the present invention can be further improved with respect to the strength, machinability and hot workability by adding to the second steel one or more of not more than 0.30% of V, not more than 0.30% of Ti, not more than 0.30% of W, not more than 0.30% of Ta, not more than 0.30% of Hf, not more than 0.30% of Zr and not more than 0.30% of Al, one or more of not more than 0.080% of Se, not more than 0.080% of Te, not more than 0.080% of S and not more than 0.100% of P, one or more of not more than 0.30% of Bi and not more than 0.30% of Pb, and one or more of from 0.0020 to 0.0100% of B, from 0.0020 to 0.0100% of Ca, from 0.0020 to 0.0100% of Mg and from 0.0020 to 0.0100% of rare earth elements. This steel will be hereinafter referred to as "seventh steel".

Figure 1:
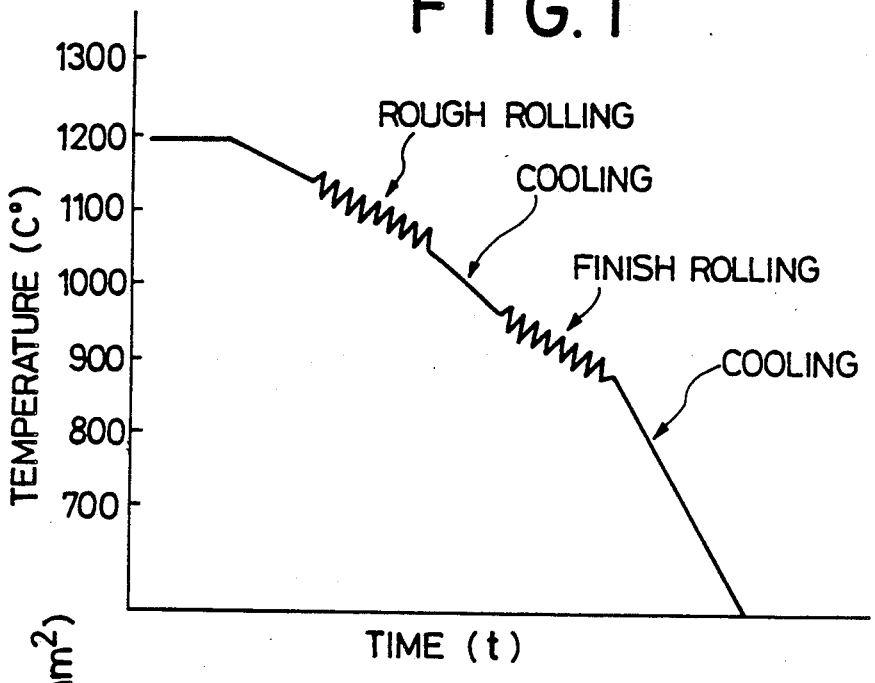
FIG. 1 is a graphical representation of the relation between the temperature and the time of a controlled rolling process according to the method of the present invention.

Further, when the first and second steels of the present invention are subjected to the controlled rolling process as shown in FIG. 1, the strength of these steels can be improved. More specifically, the controlled rolling process comprises heating the steel to 1100° to 1300° C., subjecting the heated steel to rough rolling at a rough rolling temperature of 1000° to 1200° C. and a working rate of not less than 50%, cooling it at a cooling rate of not less than 4° C./min after said rough rolling, subjecting further the rough rolled steel to finish rolling at a finish rolling temperature of 800° to 1000° C. and a working rate of not less than 20% and cooling the resultant steel at a cooling rate of not less than 4° C./min after said finish rolling. The first and second steels which have been worked by the above process will be hereinafter referred to as "eighth steel" and "ninth steel", respectively.

The "recrystallized and worked double structure" can be developed when the steels of the compositions within the scope of the present invention are subjected to said controlled rolling. In general, the structure of austenitic stainless steels is constituted of a micro structure with a size of 100 micrometers observed through an optical microscope and a substructure with a size of 1 micrometer observed through an electron microscope.

Figure 4A:
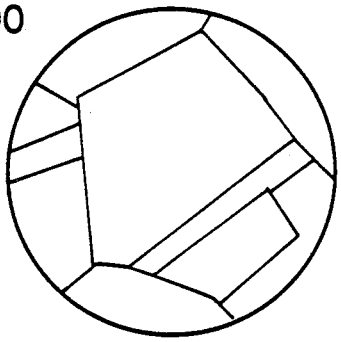
FIGS. 4A and 4B are a microstructure and a substructure of a steel which has been subjected only to thermal solid solution treatment, respectively.
Figure 4B:
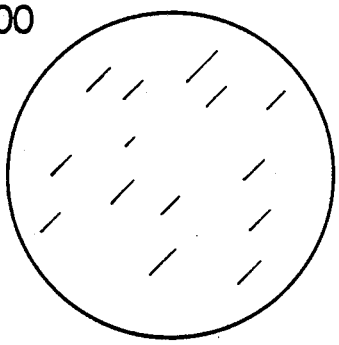
Figure 5A:
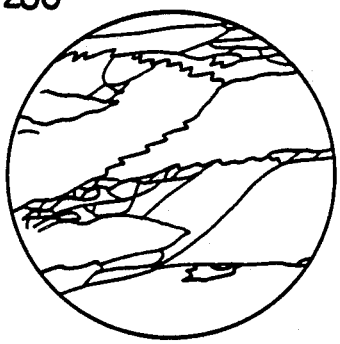
FIGS. 5A and 5B are a microstructure and a substructure of a steel which has been subjected to controlled rolling after the thermal solid solution treatment, respectively.
Figure 5B:
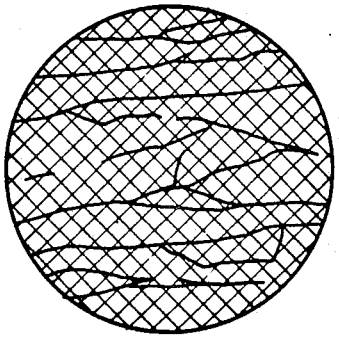
Figure 6A:
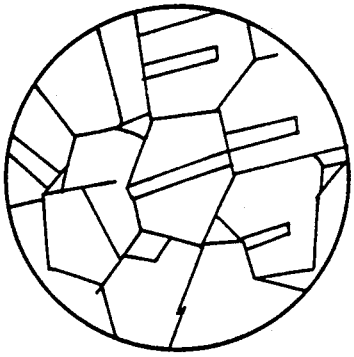
FIGS. 6A, 7A, 8A and 6B, 7B, 8B are, respectively, micro structures indicated by 200 magnifications of a "recrystallized and worked double structure" of a steel obtained by controlled rolling according to the present invention and substructures indicated by 20,000 magnifications of the recrystallized and worked double structure of the steel.
Figure 6B:
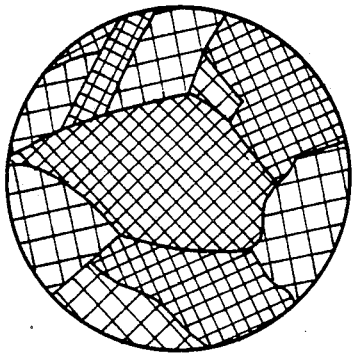
Figure 7A:
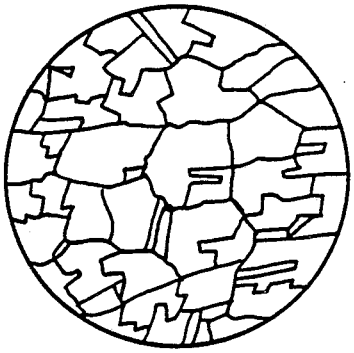
Figure 7B:
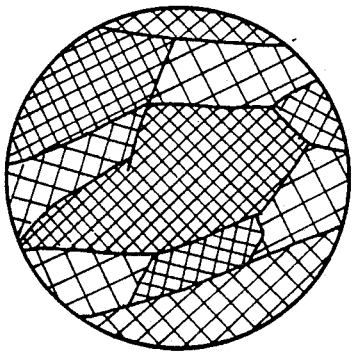
Figure 8A:
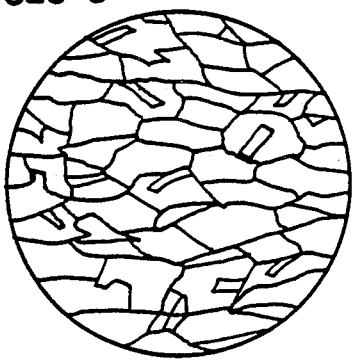
Figure 8B:
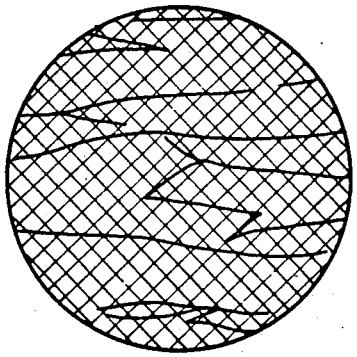

The structure of 200 magnifications and 20,000 magnifications of the steel that has been subjected only to solid solution treatment are shown in FIGS. 4A and 4B, respectively. In FIGS. 5A and 5B, there are shown the structures of 200 magnifications and 20,000 magnifications of the steel which have been subjected to said controlled rolling at a finish rolling temperature of 900° C. after the solid solution treatment. As will be seen from FIGS. 5A and 5B, the microstructure of the steel after the controlled rolling is a worked structure of a mixed grain size with the substructure being also a worked structure.

However, the structures of 200 magnifications and 20,000 magnifications of the steel subjected to controlled rolling according to the present invention include, as particularly shown in FIGS. 6A, 6B, 7A, 7B, 8A and 8B, a microstructure composed of a recrystallized structure of several tens micrometers in size and a substructure composed of a recrystallized structure of several microns in size. The crystal grains of the substructure are a recrystallized and worked double or duplex structure which is a worked structure having dislocations of a high density.

Figure 9A:
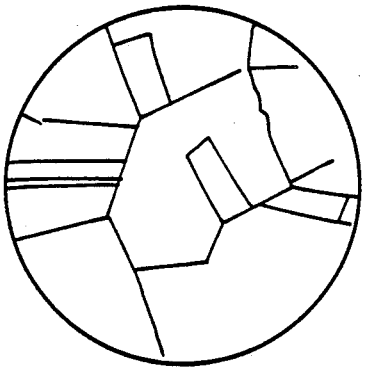
FIGS. 9A and 9B are, respectively, a microstructure and a substructure of a steel finish-rolled at a temperature of 1050° C.
Figure 9B:
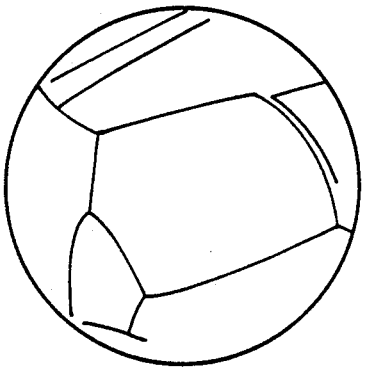
Figure 10A:
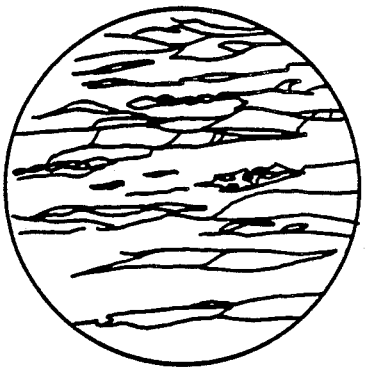
FIGS. 10A and 10B are, respectively, similar to FIGS. 9A and 9B but the steel is finish-rolled at a temperature of 770° C.
Figure 10B:
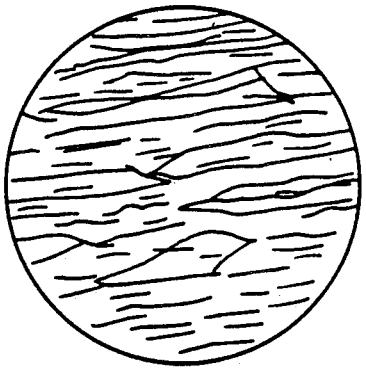

However, when the finish rolling temperature is 1050° C., little dislocations are observed in the substructure as is shown in FIGS. 9A and 9B. While the optical microscopic structure has crystal grains same as those of a fine recrystallized structure of a steel after the solid solution treatment, the structure observed through an electron microscope is a structure having worked and recrystallized crystal of several microns in size which are divided with sub-grains and have little dislocation. This type of steel has only a slight improvement in strength. When the finish rolling temperature is 770° C., any recrystallized substructure is not formed as is shown in FIGS. 10A and 10B, with the toughness being improved only slightly.

Figure 2:
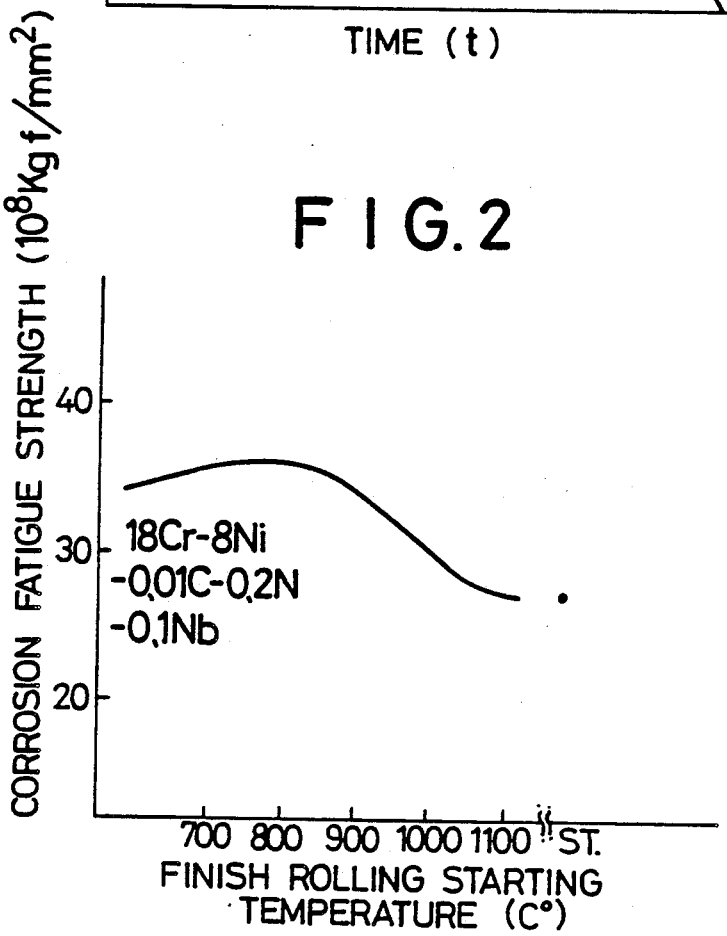
FIG. 2 is a graphical representation of the relation between corrosion fatigue strength and finish rolling temperature.

The characteristic properties of the steel having the "recrystallized and worked double structure" according to the present invention are described. FIG. 2 shows an influence of the finish rolling starting temperature on the corrosion fatigue strength. As will be clear from FIG. 2, the steel subjected to a finish rolling temperature of 800° to 1000° C. and having a recrystallized and worked double structure has an improved corrosion fatigue strength of 32 kgf/mm$^2$.

Figure 3:
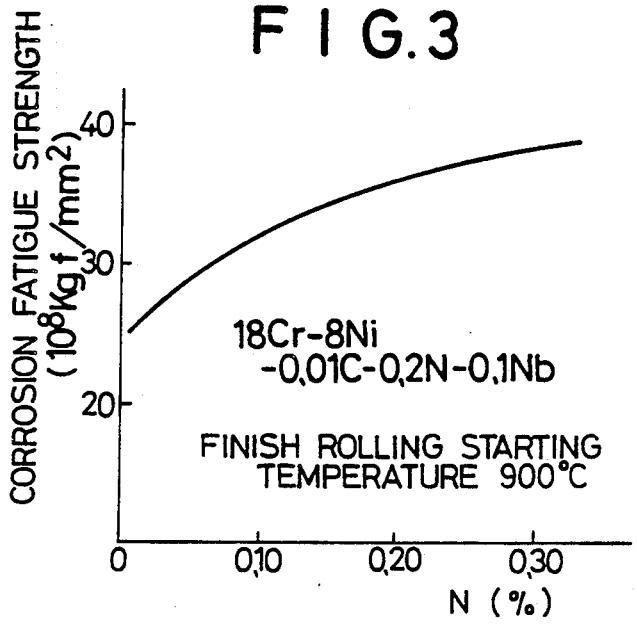
FIG. 3 is a graphical representation of the relation between corrosion fatigue strength and content of N.

FIG. 3 shows the relation between the corrosion fatigue strength and the content of N, revealing that when the content of N is more than 0.10%, the corrosion fatigue strength is improved as being more than 32 kgf/mm$^2$.

The reasons why the ranges of the respective compositions in the steel of the present invention are determined as defined are as follows:

C is an element which considerably impede the corrosion resistance after controlled rolling and its content should be suitably controlled. Accordingly, its upper limit is defined as 0.03%. The lower limit of C is determined as 0.001%.

Si is an element which is added as a deoxidizer and can improve strength. However, Si gives an adverse influence on the $\delta/\gamma$ balance at high temperature and lowers the hot workability. Moreover, it impairs a corrosion resistance and reduces an amount of N as the solid solution at the time of solidification of the steel. In this sense, the upper limit of Si is determined as 2%. The lower limit of Si is determined as 0.05%.

Mn is an element which is added as a deoxidizer and can increase an amount of N as a solid solution and for a gamma phase. If, however, the content increases, the hot workability and corrosion resistance are impaired. Thus, the upper limit is determined as 5.0%. The lower limit of Mn is determined as 0.02%.

Ni is a fundamental element of austenitic stainless steels and should be added in an amount of not less than 6% in order to impart good corrosion resistance and corrosion fatigue strength and to obtain an austenitic structure. Thus, the lower limit is determined as 6.0%.

However, when the content of Ni increases excessively, the weld cracking may take at the time of welding and the hot workability lowers. Accordingly, the upper limit is determined as 13%.

Cr is a fundamental element of stainless steels. In order to impart good corrosion resistance and corrosion fatigue strength, not less than 16% of Cr should be contained. Thus, the lower limit is determined as 16%. However, when the content of Cr increases too great, the $\delta/\gamma$ balance at high temperatures is impaired and the hot workability lowers, so that the upper limit is determined as 21%.

N is an austenite-forming element and permits the action of facilitating the solid solution, the formation of finer crystal grains and the improvement of corrosion fatigue strength. In order to obtain these effects, its content should be not less than 0.10% and the lower limit is determined as 0.10%. However, an increase in content of N results in a lowering of hot workability and a tendency toward formation of blow holes at the time of solidification or welding. Thus, the upper limit is determined as 0.30%.

Nb is an element which can improve the corrosion resistance by fixation of C and also improve the corrosion fatigue strength. It is necessary to contain Nb in the steel at least 0.02% or more. However, when the content of Nb is too great, the hot workability is impaired and thus, the upper limit is determined as 0.25%.

Mo and Cu are both elements of further improving the corrosion resistance and the corrosion fatigue strength. However, Mo and Cu are expensive elements and when they are, respectively, contained in amounts exceeding 4.0%, the hot workability deteriorates. The upper limit is determined as 4.0% for the respective elements.

S is an element which can improve the corrosion resistance by reducing the content substantially and which can also improve the ductility and toughness. Accordingly, a small content is desirable, therefore, the upper limit is determined as 0.002%.

Se, Te, S and P are elements which can improve the machinability of the steels of the present invention. However, when Se, Te and S are used in amounts exceeding 0.080%, respectively, and P is used in amounts exceeding 0.100%, the hot workability and corrosion resistance lowers. Thus, the upper limit for each of Se, Te and S is determined as 0.08% and the upper limit for P is determined as 0.100%.

V, Ti, W, Ta, Hf, Zr and Al are elements for improving the strength of a steel rolled by the controlled rolling process. However, when these elements are contained in amounts greater than as required, the improving effect is not so significant but the hot workability lowers. Thus, the upper limit of the respective elements is determined as 0.30%.

Bi and Pb are elements of improving the machinability of the steels of the present invention. If the contents of Bi and Pb are too great, the hot workability lowers and thus, the upper limit for each element is determined as 0.30%.

B, Ca, Mg and rare earth elements are elements which are used to improve the hot workability of the steel in accordance with the present invention. At least 0.0020% of the respective elements should be contained, if required. However, adding of greater amounts than as required results in a lowering of the hot workability, therefore, the upper limit for each element is determined as 0.0100%.

In the controlled rolling, the heating temperature defined from 1100° to 1300° C. is for the reason that the deformation resistance during the rolling is suppressed and Nb is sufficiently converted into solid solution. At temperatures less than 1100° C., the Nb precipitation cannot be completely dissolved as a solid solution and the deformation resistance cannot be made small. When heating temperature exceeds 1300° C., a part of the grains dissolves, leading to formation of coarse crystal grains to make the rolling difficult.

The rough rolling temperature is determined from 1000° to 1200° C. so as to obtain a fine recrystallized structure. If the temperature is less than 1000° C., the fine recrystallized structure cannot be obtained. On the other hand, when the temperature exceeds 1200° C., the crystal grains are made rough by recrystallization.

The reason why the working rate is defined at 50% or higher in the course of the rough rolling is due to the fact that at a working rate less than 50% the energy for lattice defects is so small that a fine structure cannot be obtained.

After the rough rolling, the steel is cooled at a cooling rate of not less than 4° C./min, by which a fine recrystallized structure is obtained by static recrystallization.

The reason why the finish rolling temperature is defined to be in the range of from 800° to 1000° C. is as follows: At temperatures lower than 800° C., the deformation resistance increases, making the controlled rolling process difficult, so that only a worked structure is formed, thus a "recrystallized and worked double structure" can not be obtained. If the finish rolling temperature exceeds 1000° C., a recrystallized structure alone is obtained by recrystallization and a "recrystallized and worked double structure" can not be obtained.

The working rate for the finish rolling is determined as not less than 20%. At a working rate less than 20%, the working strain is so small that a recrystallized and worked double structure having satisfactory strength cannot be obtained.

The cooling rate after the finish rolling is determined as not less than 4° C./min. This is because at a cooling rate less than 4° C./min, intergranular carbide appears, thus lowering the corrosion resistance.

The features of the steels according to the present invention are described in examples by comparison with comparative steels. Tables 1 to 5 indicate chemical composition of tested steels. More particularly, Table 1 indicates the chemical composition of the first and second steels Nos. 1–10 of the present invention, Table 2 indicates the chemical composition of the third and fourth steels Nos. 11–18, Table 3 indicates the chemical composition of the fifth steel Nos. 19–27, Table 4 indicates the chemical composition of the sixth and seventh steels Nos. 28–35, and Table 5 indicates the chemical composition of conventional steels Nos. 36–40 and comparative steels Nos. 41–45

TABLE 1

| | Chemical Composition (wt %) | | | | | | | | | |
|---|---|---|---|---|---|---|---|---|---|---|
| | C | Si | Mn | Ni | Cr | N | Nb | Mo | Cu | S |
| 1 | 0.01 | 0.31 | 2.23 | 7.83 | 18.26 | 0.21 | 0.10 | | | |
| 2 | 0.01 | 0.33 | 2.35 | 8.15 | 18.52 | 0.23 | 0.08 | | | |
| 3 | 0.01 | 0.36 | 2.65 | 8.34 | 18.26 | 0.18 | 0.12 | | | |
| 4 | 0.02 | 0.81 | 4.76 | 6.23 | 17.73 | 0.27 | 0.04 | | | |
| 5 | 0.02 | 0.50 | 1.07 | 12.15 | 20.29 | 0.15 | 0.20 | | | |
| 6 | 0.01 | 0.32 | 2.15 | 7.95 | 18.21 | 0.19 | 0.08 | 1.22 | | |
| 7 | 0.01 | 0.36 | 2.31 | 7.86 | 18.38 | 0.17 | 0.08 | 2.74 | | |
| 8 | 0.01 | 0.41 | 2.56 | 8.26 | 18.35 | 0.20 | 0.08 | | 1.73 | |
| 9 | 0.01 | 0.28 | 2.07 | 8.14 | 18.05 | 0.15 | 0.10 | | | 0.001 |
| 10 | 0.01 | 0.37 | 2.30 | 8.33 | 18.43 | 0.18 | 0.07 | 0.85 | 0.65 | 0.001 |

TABLE 2

| | Chemical Composition (wt %) | | | | | | | | | | | | | |
|---|---|---|---|---|---|---|---|---|---|---|---|---|---|---|
| | C | Si | Mn | Ni | Cr | N | Nb | Te | S | P | Bi | Pb | B | Se |
| 11 | 0.01 | 0.45 | 2.48 | 7.87 | 18.36 | 0.16 | 0.07 | | | | | | | 0.022 |
| 12 | 0.01 | 0.31 | 2.29 | 7.98 | 18.32 | 0.18 | 0.08 | 0.018 | | | | | | |
| 13 | 0.01 | 0.27 | 2.45 | 7.69 | 18.30 | 0.19 | 0.09 | | 0.012 | | | | | |
| 14 | 0.01 | 0.26 | 2.62 | 8.27 | 18.52 | 0.18 | 0.10 | | | 0.025 | | | | |
| 15 | 0.01 | 0.36 | 2.24 | 7.95 | 18.57 | 0.17 | 0.09 | 0.008 | 0.025 | | | | | |
| 16 | 0.01 | 0.29 | 2.61 | 8.25 | 18.58 | 0.19 | 0.10 | | | | 0.08 | | 0.0020 | |
| 17 | 0.01 | 0.31 | 2.30 | 8.17 | 18.28 | 0.17 | 0.08 | | | | | 0.08 | 0.0018 | |
| 18 | 0.01 | 0.33 | 2.07 | 8.05 | 18.31 | 0.19 | 0.10 | | | | 0.04 | 0.02 | 0.0065 | |

TABLE 3

| | Chemical Composition (wt %) | | | | | | | | | | | | | |
|---|---|---|---|---|---|---|---|---|---|---|---|---|---|---|
| | C | Si | Mn | Ni | Cr | N | Nb | V | Ti | W | Ta | Hf | Zr | Al |
| 19 | 0.01 | 0.31 | 2.46 | 8.32 | 18.24 | 0.16 | 0.08 | 0.10 | | | | | | |
| 20 | 0.01 | 0.45 | 2.64 | 8.52 | 18.86 | 0.21 | 0.11 | | 0.09 | | | | | |
| 21 | 0.01 | 0.36 | 2.21 | 8.24 | 18.55 | 0.18 | 0.09 | | | 0.16 | | | | |
| 22 | 0.01 | 0.28 | 2.37 | 8.45 | 18.12 | 0.20 | 0.08 | | | | 0.07 | | | |
| 23 | 0.01 | 0.34 | 2.08 | 8.21 | 18.23 | 0.17 | 0.07 | | | | | 0.13 | | |
| 24 | 0.01 | 0.36 | 2.21 | 7.96 | 18.34 | 0.19 | 0.09 | | | | | | 0.08 | |
| 25 | 0.01 | 0.30 | 2.33 | 8.42 | 18.63 | 0.20 | 0.10 | | | | | | | 0.23 |
| 26 | 0.01 | 0.32 | 2.25 | 8.20 | 18.09 | 0.18 | 0.08 | 0.04 | 0.07 | | 0.05 | | | |
| 27 | 0.01 | 0.33 | 2.16 | 8.43 | 18.67 | 0.10 | 0.08 | 0.05 | | 0.04 | | 0.03 | 0.04 | |

TABLE 4

| | Chemical Composition (wt %) | | | | | | | | | | | | | |
|---|---|---|---|---|---|---|---|---|---|---|---|---|---|---|
| | C | Si | Mn | Ni | Cr | N | Nb | Mo | Pb | S | B | Ca | Mg | REM |
| 28 | 0.01 | 0.35 | 3.24 | 7.98 | 18.05 | 0.18 | 0.07 | | | | 0.0030 | | | |
| 29 | 0.01 | 0.33 | 2.21 | 8.24 | 18.21 | 0.21 | 0.11 | | | | | 0.0025 | | |
| 30 | 0.01 | 0.28 | 2.57 | 8.14 | 18.46 | 0.22 | 0.10 | | | | | | 0.0025 | |
| 31 | 0.02 | 0.27 | 2.39 | 7.85 | 17.73 | 0.18 | 0.08 | | | | | | | 0.0035 |
| 32 | 0.01 | 0.31 | 2.74 | 8.32 | 18.65 | 0.21 | 0.13 | | | | 0.0020 | | | 0.0025 |
| 33 | 0.01 | 0.32 | 2.15 | 7.92 | 18.47 | 0.19 | 0.10 | 2.11 | 0.11 | 0.026 | | 0.0031 | 0.10 V | |
| 34 | 0.01 | 0.29 | 2.15 | 7.58 | 18.01 | 0.15 | 0.08 | 2.23 | 0.16 | 0.020 | 0.0018 | 0.0037 | 0.12 Ti | |
| 35 | 0.01 | 0.26 | 2.18 | 8.54 | 18.13 | 0.20 | 0.11 | 2.01 | 0.25 | 0.034 | 0.0018 | | 0.08 Zr | 0.0028 |

TABLE 5

| | Chemical Composition (wt %) | | | | | | | | |
|---|---|---|---|---|---|---|---|---|---|
| | C | Si | Mn | Ni | Cr | N | Nb | Mo | Cu |
| 36 | 0.06 | 0.70 | 1.25 | 8.25 | 18.10 | 0.03 | | | |
| 37 | 0.06 | 0.72 | 2.10 | 8.40 | 18.20 | 0.19 | 0.12 | | |
| 38 | 0.06 | 0.71 | 1.75 | 12.11 | 16.21 | 0.02 | | 2.24 | |
| 39 | 0.06 | 0.45 | 0.52 | 4.52 | 16.10 | | 0.35 | | 3.50 |
| 40 | 0.02 | 0.48 | 0.82 | 4.23 | 25.10 | 0.08 | | 0.83 | |
| 41 | 0.01 | 0.30 | 2.20 | 7.83 | 18.25 | 0.21 | 0.10 | | |
| 42 | 0.01 | 0.28 | 2.24 | 8.12 | 18.39 | 0.21 | 0.09 | | |
| 43 | 0.01 | 0.33 | 2.52 | 8.02 | 18.15 | 0.19 | 0.08 | | |
| 44 | 0.06 | 0.45 | 2.08 | 7.92 | 18.25 | 0.18 | 0.07 | | |
| 45 | 0.02 | 0.38 | 2.01 | 8.11 | 15.10 | 0.15 | 0.05 | | |

In Table 6, steel structure, finish rolling temperature, corrosion fatigue strength, endurance, pitting potential, elongation, machinability and hot workability of test results on the steels indicated in Tables 1–5 are shown.

Conventional steels Nos. 36–40 and comparative steel No. 41 were subjected to thermal solid solution treatment in which the steels were heated at a temperature of 1050° C. for 30 minutes and cooled with water. Steels Nos. 1–35 in accordance with the present invention and comparative steels Nos. 42–45 were subjected to the controlled rolling process in which the steels were heated to a temperature of 1200° C., roughly rolled at a temperature of 1100° C. at a working rate of 80%, cooled at a cooling rate of not less than 50° C./min, subsequently accurately rolled (finish rolling) at a temperature which is indicated in Table 6 as a finish rolling temperature at a working rate of 50% and then cooled at a cooling rate of not less than 50° C./min. Corrosion fatigue strength, endurance, pitting potential, elongation, machinability, hot workability (drawing rate) were measured on the finish rolled steels.

recrystallized structure, and W indicates a worked structure.

The corrosion fatigue strength was evaluated by subjecting a test piece which is soaked in seawater to a rotary bending fatigue test and expressing it by $10^8$ kgf/mm$^2$. The endurance and elongation were measured using a No. 4 test piece which is defined by Japanese Industrial Standard.

The corrosion resistance in seawater was determined by measuring a pitting potential in an aqueous 35% NaCl solution at a temperature of 30° C. The machinability was determined by a drill life test in which a 20 mm long test piece was machined with a drill made of a high speed tool steel SKH (JIS) of 9.5 mm in diameter and under condition of at a revolution rate of 527 rpm and at a feeding rate of 0.06 mm/rev.

The hot workability was determined by subjecting a test piece to a high speed and high temperature tensile test using the Gleeble (tradename) apparatus under conditions of a temperature of 1100° C. and a pulling speed of 50 mm/sec to measure a drawing rate (%).

TABLE 6

| | Structure (Finish Rolling Temperature °C.) | Corrosion Fatigue Strength (kgf/mm$^2$) | Endurance (kgf/mm$^2$) | Pitting Potential (mV) | Elongation (%) | Machin-ability | Hot Workability Drawing Rate (%) | Difficulty in Correction (O) |
|---|---|---|---|---|---|---|---|---|
| 1 | D (820) | 37 | 88 | 330 | 36 | 35 | 93 | |
| 2 | D (900) | 36 | 80 | 330 | 35 | | | |
| 3 | D (980) | 33 | 62 | 330 | 38 | | | |
| 4 | D (900) | 38 | 85 | 320 | 32 | | | |
| 5 | D (900) | 36 | 75 | 420 | 37 | | | |
| 6 | D (900) | 40 | 84 | 510 | 32 | | | |
| 7 | D (900) | 42 | 86 | 680 | 31 | | | |
| 8 | D (900) | 40 | 78 | 350 | 38 | | | |
| 9 | D (900) | 40 | 80 | 400 | 38 | | | |
| 10 | D (900) | 41 | 82 | 530 | 37 | | | |
| 11 | D (900) | 33 | 80 | 320 | 32 | 120 | | |
| 12 | D (900) | 34 | 79 | 330 | 34 | 110 | | |
| 13 | D (900) | 32 | 80 | 310 | 30 | 120 | | |
| 14 | D (900) | 33 | 81 | 320 | 32 | 100 | | |
| 15 | D (900) | 33 | 80 | 320 | 31 | 130 | | |
| 16 | D (900) | 35 | 80 | 320 | 35 | 180 | 91 | |
| 17 | D (900) | 35 | 80 | 310 | 35 | 170 | 90 | |
| 18 | D (900) | 35 | 80 | 320 | 35 | 170 | 90 | |
| 19 | D (900) | 36 | 84 | 340 | 34 | | | |
| 20 | D (900) | 36 | 84 | 340 | 34 | | | |
| 21 | D (900) | 36 | 84 | 340 | 34 | | | |
| 22 | D (900) | 36 | 84 | 340 | 34 | | | |
| 23 | D (900) | 36 | 84 | 340 | 34 | | | |
| 24 | D (900) | 36 | 84 | 340 | 34 | | | |
| 25 | D (900) | 36 | 83 | 340 | 34 | | | |
| 26 | D (900) | 37 | 85 | 340 | 33 | | | |
| 27 | D (900) | 37 | 85 | 340 | 33 | | | |
| 28 | D (900) | 35 | 80 | 320 | 35 | | 95 | |
| 29 | D (900) | 34 | 80 | 310 | 35 | | 95 | |
| 30 | D (900) | 34 | 80 | 310 | 35 | | 95 | |
| 31 | D (900) | 34 | 80 | 320 | 35 | | 95 | |
| 32 | D (900) | 34 | 80 | 310 | 35 | | 96 | |
| 33 | D (900) | 41 | 85 | 670 | 32 | 170 | 88 | |
| 34 | D (900) | 40 | 84 | 680 | 33 | 180 | 88 | |
| 35 | D (900) | 43 | 85 | 750 | 32 | 180 | 88 | |
| 36 | R (SST) | 18 | 24 | 280 | 58 | | | |
| 37 | R (SST) | 26 | 43 | 300 | 54 | | | |
| 38 | R (SST) | 22 | 27 | 420 | 54 | | | |
| 39 | R (SST) | 32 | 102 | 170 | 20 | | | O |
| 40 | R (SST) | 28 | 48 | 680 | 25 | | | |
| 41 | R (SST) | 28 | 42 | 340 | 55 | | | |
| 42 | R (1050) | 28 | 45 | 320 | 48 | | | |
| 43 | W (700) | 35 | 102 | 320 | 15 | | | O |
| 44 | D (900) | 24 | 75 | 250 | 30 | | | |
| 45 | D (900) | 22 | 74 | 90 | 38 | | | |

Note; SST . . . Steels subjected only to solid solution treatment

Structure of the steels indicated in Table 6 is observed on the finish rolled steel in which D indicates a "recrystallized and worked double structure", R indicates a Examples of heating temperature, rough rolling temperature, working rate of rough rolling, cooling rate after rough rolling, finish rolling temperature, working rate of finish rolling and cooling rate after finish rolling of the controlled rolling process in accordance with the present invention are indicated in Table 7 which were applied to the steels Nos. 1 and 7.

Structure, corrosion fatigue strength, endurance, pitting potential and elongation observed on and measured on the respective finish rolled steel are shown in Table 8.

TABLE 7

| | Heating Temperature (°C.) | Rough Rolling Temperature (°C.) | Working Rate (%) | Cooling Rate after Rough Rolling (°C./min) | Finish Rolling Temperature (°C.) | Working Rate (%) | Cooling Rate after Finish Rolling (°C./min) |
|---|---|---|---|---|---|---|---|
| 1 | 1150 | 1100 | 80 | 50 | 800 | 35 | 50 |
| | 1150 | 1100 | 80 | 60 | 980 | 70 | 30 |
| | 1250 | 1150 | 70 | 70 | 900 | 60 | 70 |
| 7 | 1150 | 1100 | 70 | 50 | 820 | 60 | 50 |
| | 1150 | 1050 | 80 | 60 | 800 | 35 | 30 |
| | 1200 | 1100 | 70 | 40 | 980 | 70 | 70 |

TABLE 8

| | Structure (Finish Rolling Temperature °C.) | Corrosion Fatigue Strength (kgf/mm$^2$) | Endurance (kgf/mm$^2$) | Pitting Potential (mV) | Elongation (%) |
|---|---|---|---|---|---|
| 1 | D (800) | 37 | 86 | 330 | 33 |
| | D (980) | 34 | 67 | 330 | 38 |
| | D (900) | 36 | 82 | 310 | 34 |
| 7 | D (820) | 42 | 87 | 680 | 30 |
| | D (800) | 41 | 84 | 680 | 32 |
| | D (980) | 38 | 70 | 660 | 35 |

As will be apparent from Table 6, all the steels 1–35 in accordance with the present invention have the "recrystallized and worked double structure" as a result of being subjected to controlled rolling process according to the present invention and have good corrosion fatigue properties, corrosion resistance in seawater and mechanical strength, i.e. a corrosion fatigue strength of not less than 32 kgf/mm$^2$, and endurance of not less than 62 kgf/mm$^2$, a pitting potential of not less than 310 mV and an elongation of not less than 30%.

The second steels Nos. 6–10 to which at least one of Mo, Cu and S is added have a better corrosion resistance and the third steels Nos. 11–15 in which at least one of S, Te, P and Se is incorporated have better machinability. In addition, the fourth steels Nos. 16–18 to which B and at least one of Bi and Pb are added have improved machinability without lowering of the hot workability. The fifth steels Nos. 19–27 in which at least one of V, Ti, W, Ta, Hf, Zr and Al is incorporated have an improved endurance. The sixth steels Nos. 28–32 in which at least one of B, Ca, Mg, and rare earth elements is incorporated have an improved hot workability and the seventh steels Nos. 33–35 to which the above elements are added have improved corrosion resistance, machinability, strength and hot workability.

In contrast, the steel No. 36 among the conventional steels Nos. 36–40 which were subjected to the thermal solid solution treatment is poor in characteristics and exhibits a corrosion fatigue strength of 18 kgf/mm$^2$, an endurance of 24 kgf/mm$^2$, and a pitting potential of 280 mV. With regard to the steels Nos. 37 and 38, although the pitting potential is as high as 300 mV, the corrosion fatigue strength and endurance are poor. The steel No. 39 has a good corrosion fatigue resistance, but exhibits a pitting potential as low as 170 mV. The steel No. 40 and a good pitting potential of 680 mV, but is low in corrosion fatigue strength and endurance.

The steel No. 41 which has a chemical composition within the scope of the present invention and was subjected to thermal solid solution treatment, and the steel No. 42 which was subjected to finish rolling at a temperature of 1050° C., have a recrystallized structure and exhibit good pitting potential and elongation, respectively, but are poor in corrosion fatigue strength and endurance. The steel No. 43 which was subjected to finish rolling at a temperature of 700° C. has a worked structure and good corrosion fatigue strength and pitting potential, but is low in elongation. The steel No. 44 which was treated under the same conditions as in the controlled rolling process according to the present invention exhibits low pitting potential since its content of C is so high. The steel No. 45 exhibits low pitting potential since its content of Cr is low.

As will be apparent from the above results, the austenitic stainless steels of the present invention have suitable amounts of N and Nb and a reduced amount of C and are subjected to controlled rolling process, thereby obtaining a "recrystallized and worked double structure". As a result, the austenitic stainless steels of the present invention have a high corrosion fatigue characteristic, corrosion resistance in seawater and endurance, i.e. a corrosion fatigue strength of not less than 32 kgf/mm$^2$, an endurance of not less than 62 kgf/mm$^2$, and a pitting potential of not less than 310 mV. Thus, the steels of the present invention are suitable for use in propeller shafts and pump shafts for ships and contribute highly to the industries.

What is claimed as new and desired to be secured by Letters Patent of the United States is:

1. A method of producing a stainless steel having a good corrosion resistance and a good resistance to corrosion in seawater comprising the steps of preparing a steel ingot from a steel including, by weight, not more than 0.03% C, not more than 2.0% Si, not more than 5.0% Mn, 6–13% Ni, 16–21% Cr, 0.10–0.30% N and 0.02–0.25% Nb, the remainder being Fe and inevitable impurities; heating said ingot to a temperature ranging from 1,100° to 1,300° C.; roughly rolling said ingot at a temperature ranging from 1,000° to 1,200° C. at a reduction rate of more than 50% and cooling rolled ingot under a cooling rate of 4° C./min after said roughly rolling, and subsequently accurately rolling said just rolled ingot at a temperature ranging from 800°–1,000° C. at a reduction rate of more than 20% and cooling thereof under a cooling rate of 4° C./min after said accurately rolling.

2. A method as claimed in claim 1 in which a steel ingot is prepared from a steel including, by weight, not more than 0.03% C, not more than 2.0% Si, not more than 5.0% Mn, 6–13% Ni, 16–21% Cr, 0.10–0.30% N, 0.02–0.25% Nb, and a member or members selected from the group consisting of not more than 4.0% Mo, not more than 4.0% Cu and not more than 0.002% S, the remainder being Fe and inevitable impurities.

3. A method as claimed in claim 1 in which a steel ingot is prepared from a steel including, by weight, not more than 0.03% C, not more than 2.0% Si, not more than 5.0% Mn, 6–13% Ni, 16–21% Cr, 0.10–0.30% N, 0.02–0.25% Nb, and a member or members selected from the group consisting of not more than 0.080% Se, not more than 0.080% Te, not more than 0.080% S and not more than 0.10% P, the remainder being Fe and inevitable impurities.

4. A method as claimed in claim 1 in which a steel ingot is prepared from a steel including, by weight, not more than 0.03% C, not more than 2.0% Si, not more than 5.0% Mn, 6–13% Ni, 16–21% Cr, 0.10–0.30% N, 0.02–0.25% Nb, not more than 0.01% B and a member or members selected from the group consisting of not more than 0.30% Bi and not more than 0.30% Pb, the remainder being Fe and inevitable impurities.

5. A method as claimed in claim 1 in which a steel ingot is prepared from a steel including, by weight, not more than 0.03% C, not more than 2.0% Si, not more than 5.0% Mn, 6–13% Ni, 16–21% Cr, 0.10–0.30% N, 0.02–0.25% Nb, and a member or members selected from the group consisting of not more than 0.30% V, not more than 0.30% Ti, not more than 0.30% W, not more than 0.30% Ta, not more than 0.30% Hf, not more than 0.30% Zr and not more than 0.30% Al, the remainder being Fe and inevitable impurities.

6. A method as claimed in claim 1 in which a steel ingot is prepared from a steel including, by weight, not more than 0.03% C, not more than 2.0% Si, not more than 5.0% Mn, 6–13% Ni, 16–21% Cr, 0.10–0.30% N, 0.02–0.25% Nb, and a member or members selected from the group consisting of 0.002–0.010% B, 0.002–0.010% Ca, 0.002–0.010% Mg and 0.002–0.010% REM, the remainder being Fe and inevitable impurities.

7. A method as claimed in claim 1 in which a steel ingot is prepared from a steel including, by weight, not more than 0.03% C, not more than 2.0% Si, not more than 5.0% Mn, 6–13% Ni, 16–21% Cr, 0.10–0.30% N, 0.02–0.25% Nb, a member or members selected from the group consisting of not more than 4.0% Mo and not more than 4.0% Cu, a member or members selected from the group consisting of not more than 0.30% V, not more than 0.30% Ti, not more than 0.30% W, not more than 0.30% Ta, not more than 0.30% Hf, not more than 0.30% Zr and not more than 0.30% Al, a member or members selected from the group consisting of not more than 0.08% Se, not more than 0.08% Te, not more than 0.08% S and not more than 0.10% P, a member or members selected from the group consisting of not more than 0.30% Bi and not more than 0.30% Pb and a member or members selected from the group consisting of 0.002–0.010% B, 0.002–0.010% Ca, 0.002–0.010% Mg and 0.002–0.010% REM, the remainder being Fe and inevitable impurities.

* * * * *